US005233717A

United States Patent [19]

Weber et al.

[11] Patent Number: 5,233,717

[45] Date of Patent: Aug. 10, 1993

[54] METHOD AND DEVICE FOR TREATMENT OF A MATERIAL WEB, IN PARTICULAR A FABRIC WEB

[75] Inventors: Hans Weber, Uzwil; Werner Keller, Niederuzwill, both of Switzerland

[73] Assignee: Benninger Ag, Switzerland

[21] Appl. No.: 656,160

[22] PCT Filed: Sep. 18, 1990

[86] PCT No.: PCT/CH90/00221

§ 371 Date: May 2, 1991

§ 102(e) Date: May 2, 1991

[87] PCT Pub. No.: WO91/04367

PCT Pub. Date: Apr. 4, 1991

[30] Foreign Application Priority Data

Sep. 22, 1989 [CH] Switzerland ..... 3450/89

[51] Int. Cl.[5] ..... D06B 3/12

[52] U.S. Cl. ..... 8/149.1; 8/151; 68/5 E; 68/181 R; 68/205 R

[58] Field of Search ..... 8/149.1, 151; 68/5 D, 68/5 E, 20, 205 R, 6, 181 R

[56] References Cited

U.S. PATENT DOCUMENTS

| | | | |
|---|---|---|---|
| 2,008,230 | 7/1935 | Spooner | 68/5 D |
| 2,398,856 | 4/1946 | Reel | 68/6 |
| 2,900,991 | 8/1959 | Arnold | 68/205 R X |
| 3,222,895 | 12/1965 | Sheppard | 68/5 D |
| 3,241,343 | 2/1966 | Yazawa . | |
| 3,493,422 | 9/1970 | Berry, Jr. . | |
| 3,750,428 | 8/1973 | Bruckner | 68/205 R X |
| 3,940,955 | 3/1976 | Welsh | 68/181 R X |
| 4,005,500 | 2/1977 | Rayment | 68/205 R X |
| 4,466,149 | 8/1984 | Schuierer | 68/205 R X |

FOREIGN PATENT DOCUMENTS

| | | | |
|---|---|---|---|
| 0043083 | 1/1982 | European Pat. Off. . | |
| 0083065 | 7/1983 | European Pat. Off. . | |
| 3012612 | 10/1981 | Fed. Rep. of Germany . | |
| 1157034 | 12/1957 | France | 68/5 D |
| 2255961 | 7/1975 | France . | |
| 575036 | 4/1976 | Switzerland . | |

*Primary Examiner*—Philip R. Coe

*Attorney, Agent, or Firm*—Shoemaker and Mattare, Ltd.

[57] ABSTRACT

The material web (15) is guided through a treatment zone which is formed by numerous collector tubes (33, 34, 35) and by a shaft. Each collector tube is provided with a separate connection (36, 37, 38) and can be fed with its own treatment medium. The collector tubes preferably form a unit which is adjustable through a limited range in relation to the fabric web (15). Through the combined use of liquid and gaseous treatment mediums (44, 45, 46) an intense effect can be achieved, for example for washing, impregnating or similar.

9 Claims, 10 Drawing Sheets

METHOD AND DEVICE FOR TREATMENT OF A MATERIAL WEB, IN PARTICULAR A FABRIC WEB

Figure 1:
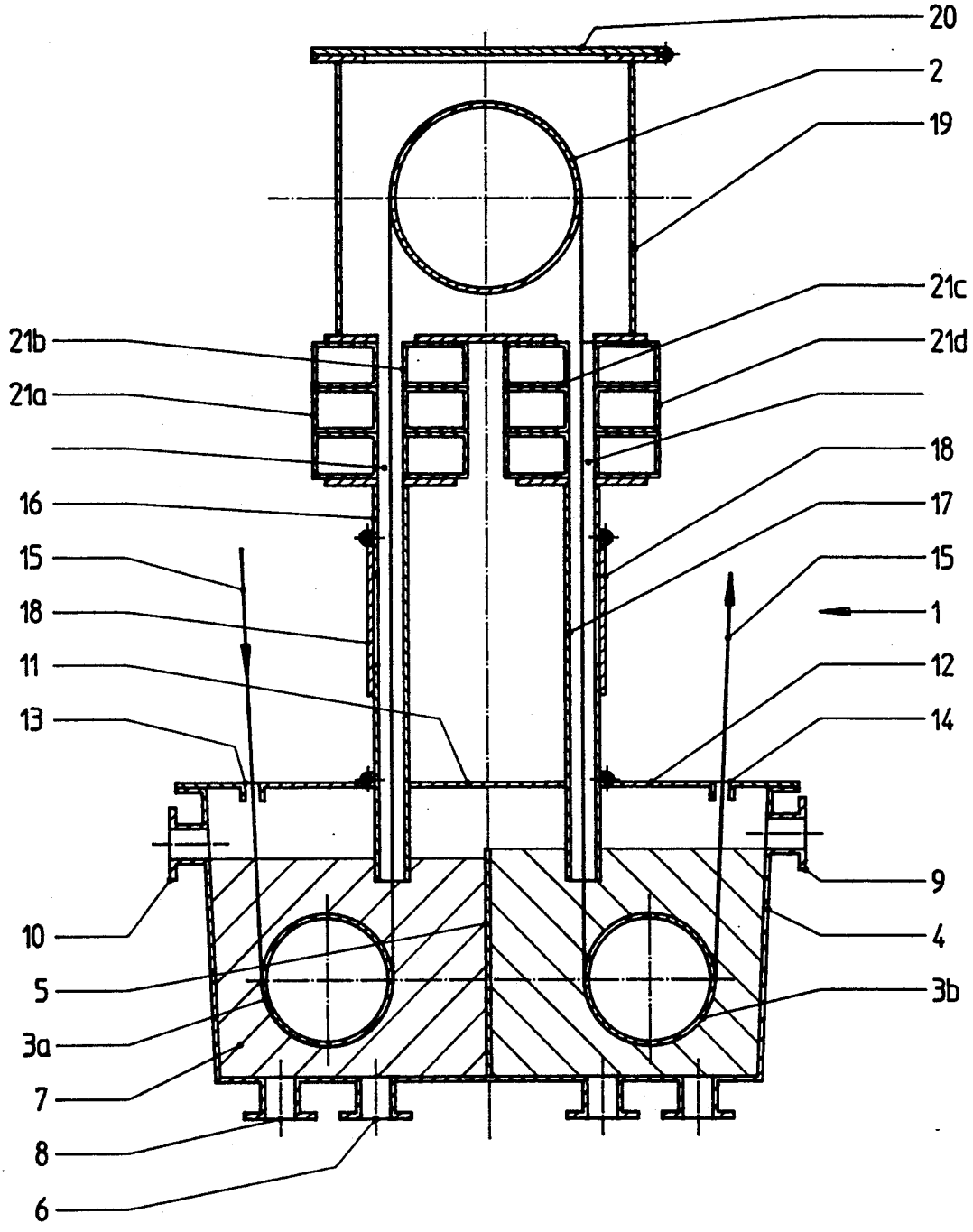

The invention concerns a method of treatment of a material web, in particular a fabric web. These types of treatment methods are employed especially when washing the fabric web in order to remove the remains of dyes, size and other treatment mediums. The method could also be employed for other purposes apart from cleaning of the fabric web, for example for impregnation or similar. The invention also concerns a suitable device for carrying out the method.

Related and comparable methods are already known, respectively devices with which washing water is sprayed onto the fabric web out of an arrangement of nozzles which extends over its entire width. For example, EP-A-43 083 shows a device for washing longer webs with which an arrangement of washing nozzles, comprising a box shaped body, is provided on each side of the fabric web at a mutual distance. The nozzles, together with the fabric web to be washed, form chamber-like recesses, so that the web can be treated very intensively with fresh water. In DE-A-14 60 174 a method and a device for continuous wet treatment of fabric material webs with liquids is described. In order to achieve a high degree of effectiveness with as small an amount of liquor as possible, the web is transported through two interconnecting chambers, whereby a high flow speed in the chambers is aimed at, since liquor is drawn-off by means of a pump from one chamber and is fed into the other chamber with high speed through a tangential nozzle.

As a rule, the known methods and devices are only concerned with how a liquid treatment medium can be applied to the material web in an especially effective way, respectively how it can be removed again. Until now, insufficient attention has been payed to the economical use of water and the problem of disposal of waste. So, for example, the degree of washing effectiveness is to a considerable extent a function of the amount of water supplied per kilogram of product. Until now a considerable amount of water has had to be employed in order to achieve the desired degree of effectiveness. Fresh water, however, causes high costs to an increasing degree, whereby the problem of purification of the soiled water must also be considered.

It is therefore a purpose of the invention to create a method of the type mentioned in the introduction with which a higher degree of treatment effectiveness is achieved with the most economical use of the treatment medium possible, and with which especially a fabric web can be washed with a small supply of fresh water by a simple and technically easily controlled means. The concentration of the wash liquor which is to be disposed of shall be as high as possible, so that, if necessary, the reclamation of the materials contained within it is also possible. According to the invention, this purpose is fulfilled with a method described below.

In practice, the confined shaft itself forms a nozzle in which the treatment medium can take effect on the material web intensively and during a sufficiently long period of time. The maintenance of an over-pressure relative to atmospheric pressure causes a turbulent flow of relatively high speed in one direction of the shaft. The use of a vaporous, respectively a gaseous, treatment medium has the advantage that the use of liquid treatment medium can be kept as low as possible. The materials detached from the fabric web by the vapor accumulate with a high concentration in the liquid components, whilst the vapor is easily drawn off and can be once again supplied after a preparation process. The material web can be additionally acted upon with a liquid treatment medium out of a separate arrangement of nozzles. The use of saturated steam and/or air and of wash liquor is also conceivable, whereby each medium is introduced into the chamber out of a separate arrangement of nozzles, respectively is applied to the material web. A wash liquor applied to the material web can, for example, be subsequently removed again by a gaseous medium, respectively partly vaporized so that no special squeezing rollers are required to squeeze out the wash water. The action of the treatment medium ensues preferably on both sides of the material web and/or consecutively in the direction of movement. It would also be conceivable to act upon the material web from one side only, respectively to introduce different treatment mediums on different sides, respectively at different positions within the shaft.

An ascending and descending span, each led through a separate shaft, is particularly advantageous, whereby the action of the treatment medium ensues in the case of both shafts at the upper end and whereby both the shafts are interconnected at their upper ends and the treatment mediums are drawn off from the lower ends of both the shafts. The material web can, however, also run through numerous approximately vertical shafts which are arranged next to or above one another and with which the action of the treatment medium ensues in each case at the upper ends and with which the treatment medium is drawn off at the lower ends.

The liquid components of the treatment mediums can be collected in a basin, which can also take the form of an immersion bath, at the lower end of each channel. The liquid could also, however, be drawn off directly from the shaft. It is especially advantageous if the liquid collected in one shaft is lead in counterflow to the arrangement of nozzles to a shaft positioned in front. This counterflow principle is used mainly when washing, whereby with increasing cleansing steps, ever purer washing water is applied. In the final treatment zone the liquid treatment medium can, with that, be fresh water.

Preferably, the pressure and/or the flow rate of the supplied treatment medium can be separately controlled for each medium. In this way, according to the nature of the material web, different conditions can be achieved in the treatment zones.

The method can be carried out in an especially simple and advantageous way with an apparatus described below. With separated arrangements of nozzles possessing separate supply piping, the shaft can be fed with optional liquid, gaseous or, in certain circumstances even solid granular treatment mediums. Thus, it would be conceivable to act upon the material web with a pourable abrasive sand in order to aim at a definite surface effect. A subsequent air nozzle could then once again blow away any particles of sand which may still adhere.

In order to design the treatment zones as flexibly as possible, it is advantageous if at least three arrangements of nozzles in the form of separate collector tubes are combined with one another in a unit. In this way numerous different treatment mediums can be employed consecutively, whereby it is, however, also possible to switch-off individual collector tubes according to requirements. This enables the device to be used for totally different purposes without laborious alterations. Preferably, opposing arrangements of nozzles are provided on both sides of the material web. Distortion of the material web as a result of the pressure acting upon it can thus be avoided since since the pressure of the opposing medium flow is mutually compensated.

The distance between the material web and the arrangement of nozzles is preferably adjustable. In this way it can be so achieved that the material strip within the treatment zone runs through a narrow slit without frictional points of contact arising. The collector tubes, used as arrangements of nozzles, have preferably a rectangular cross section since these tubes can be combined into a unit with particular advantage. The collector tubes, so combined with one another, form preferably a gastight wall section of the treatment zone, which can be dismantled and/or displaced. This type of construction has the advantage over known treatment zones in that a gastight chamber does not still have to be constructed around the arrangements of nozzles. The connections for the collector tubes are immediately accessible from the outside, so that no additional ducts or seals are required.

The collector tubes, respectively the treatment zones, can be arranged at any desired relative position of the material web. For reasons of space, numerous vertical shafts are preferably arranged next to one another, whereby a separate chamber is provided beneath each shaft. For realisation of the counterflow principle mentioned in the introduction, at least one chamber can be connected to the suction pipe of a pump whose pressure pipe leads to a collector tube which is allocated to a shaft positioned in front.

The collector tubes can exhibit nozzles whose flow axes, respectively planes of flow are inclined in relation to the plane of the material web running through. The axes, respectively the planes, can also be set at rightangles to the material web. Finally, it is also conceivable that the axes, respectively planes, of neighbouring collector tubes cross each other, whereby the crossing point can lie either in front of or behind the material web.

Since the inside pressure of the shaft is above atmospheric pressure, high mechanical loading can arise with the relatively large wall surfaces. With the very small slit width of the shaft it is also important that the planes of the side walls run absolutely parallel to one another, also under thermal and mechanical loading, in order to avoid frictional points of contact with the material web. This problem can be solved in an especially simple way in that each shaft, in cross section, exhibits hollow side walls, and that a heating medium is able to be fed to the side walls. The side walls can, with that, be formed by hollow box profiles stacked horizontally upon one another, whose end faces are closed off and which are connected with each other through openings. In this way a particularly stable and tortionally rigid box structure is achieved. Heating of the hollow walls has the effect that the outside of the wall structure exhibits approximately the same temperature as the inside which is oriented to the material web. Temperature determined changes in position are therefore eliminated. Apart from that, the heating of the side walls has the effect that vaporous treatment mediums will not condense too rapidly.

The collector tubes being used as arrangements of nozzles can be formed by the same hollow box profiles as the side walls. In this way, the side walls form a compact unit into which the arrangement of nozzles is integrated. The slit width of each shaft is preferably able to be set by means of an adjustment device so that the optimum gap width can be individually selected.

Further individual features and advantages of the invention arise out of embodiments both described in the following and represented in the drawings. Namely:

FIG. 1 a high performance washing machine, in cross section, with the features of the invention.

Figure 2:
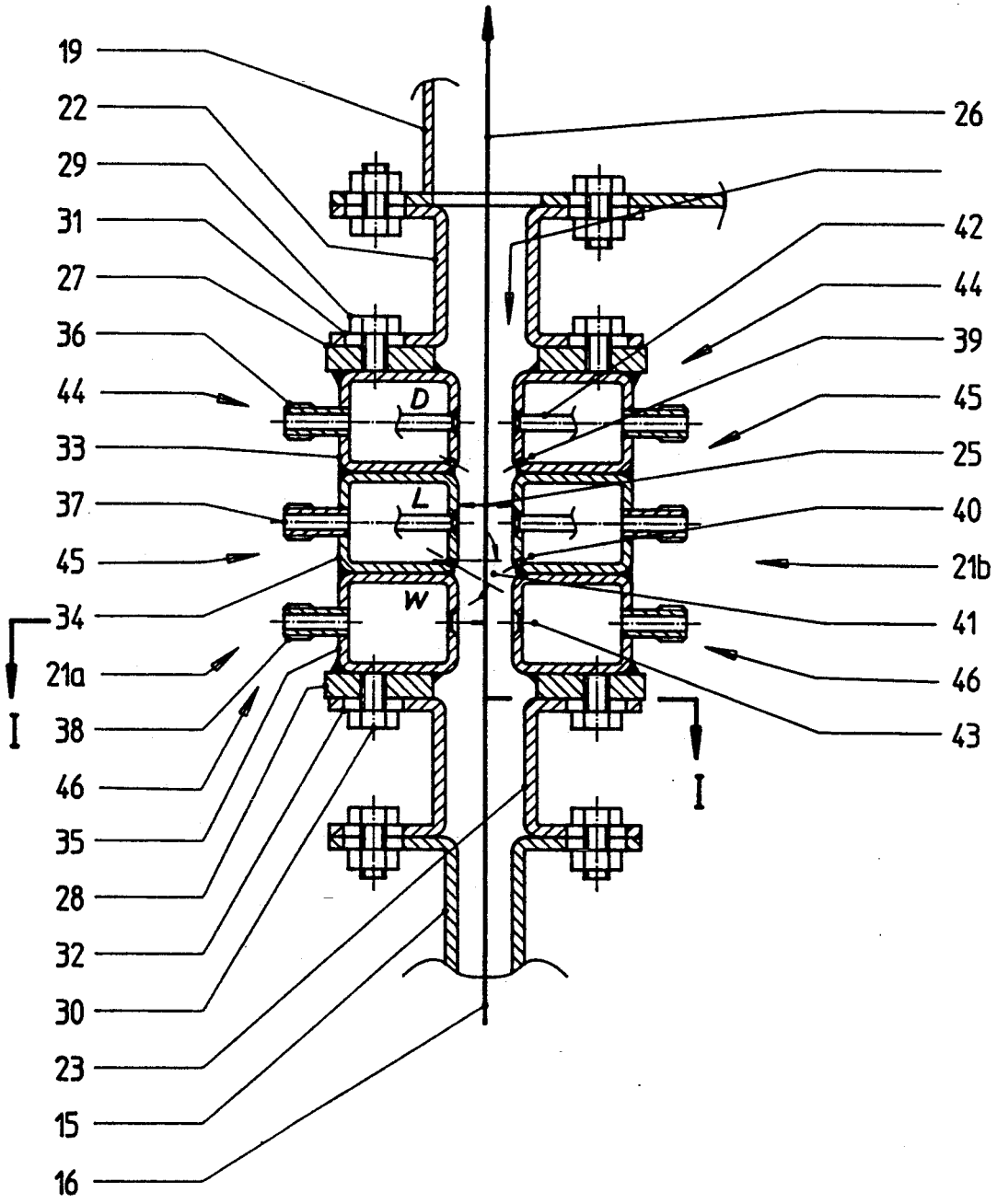
Figure 3:
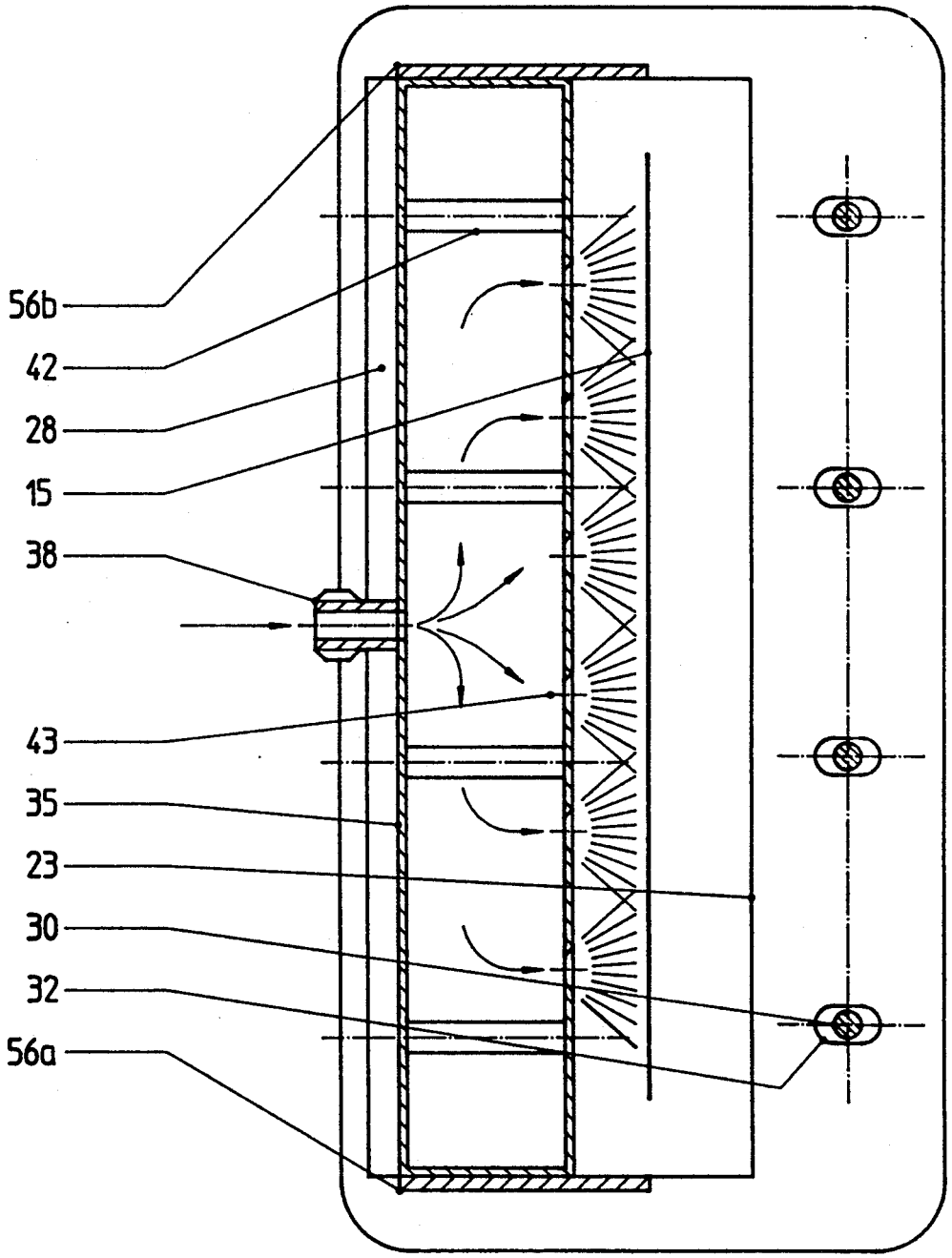
Figure 4:
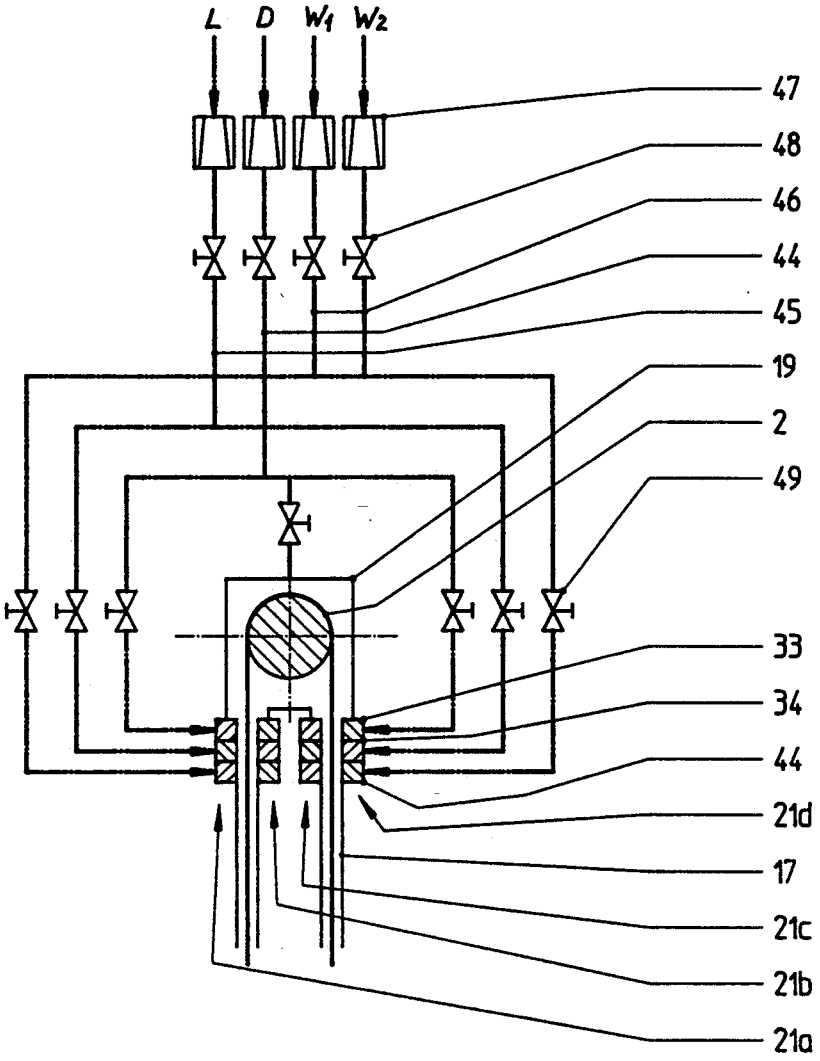
Figure 5:
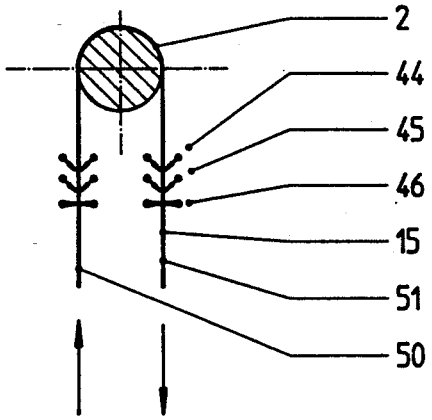
Figure 6:
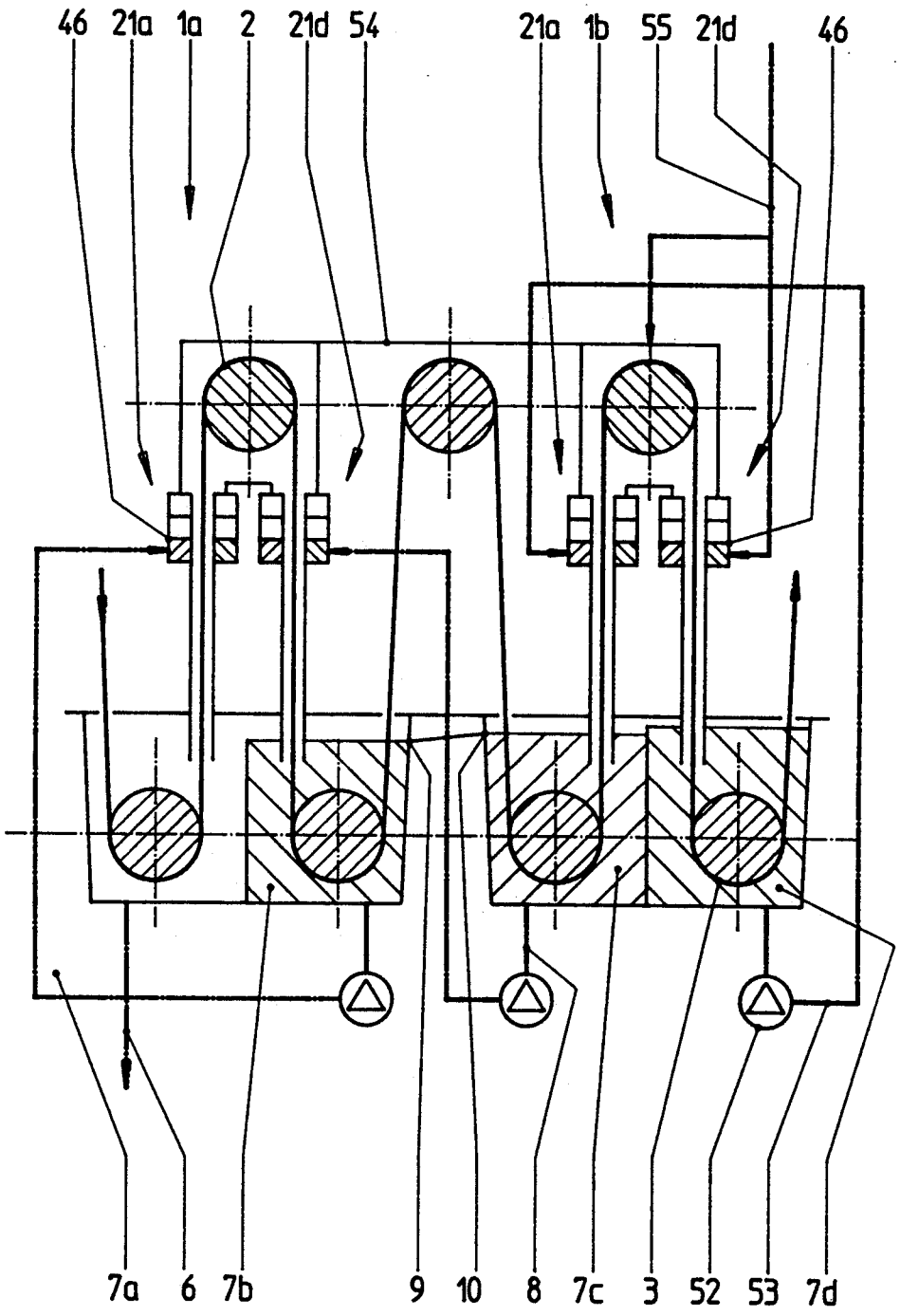
Figure 7:
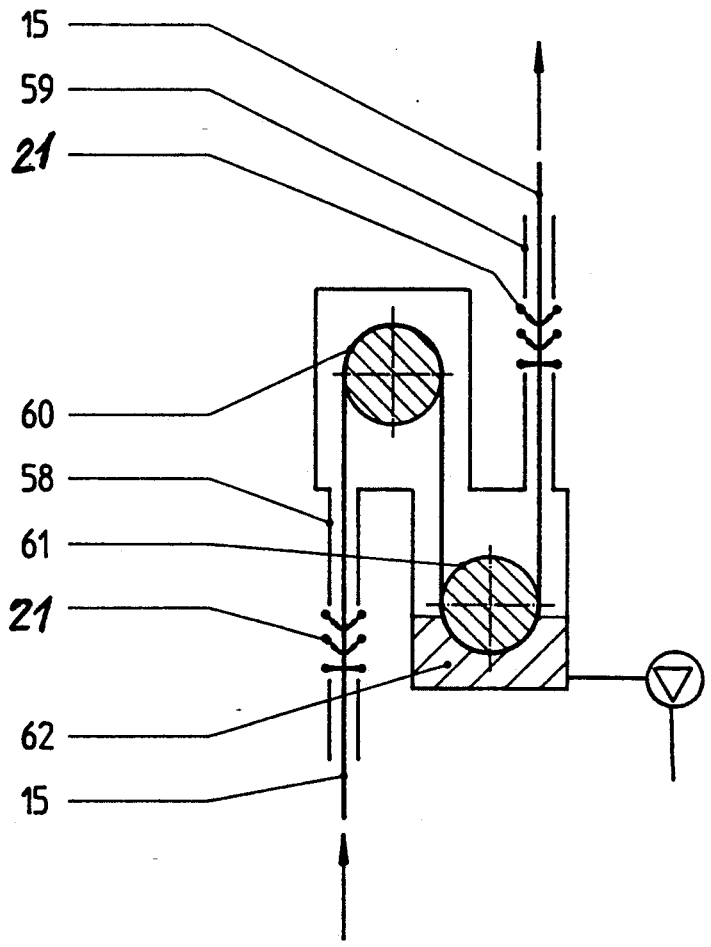
Figure 8A:
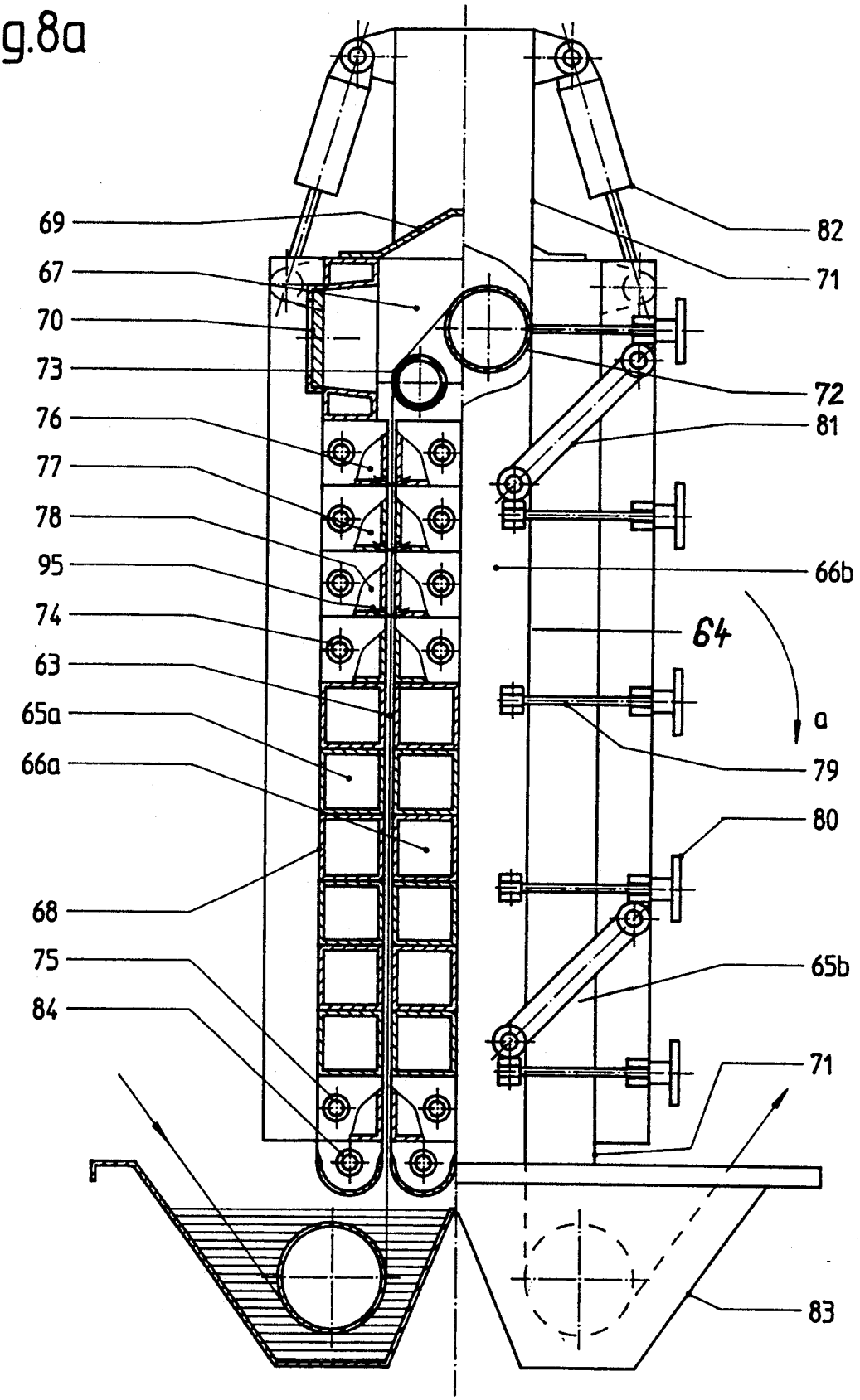

FIG. 2 an enlarged representation of a treatment zone from FIG. 1,

FIG. 3 a stepped section through the plane I - I according to FIG. 2,

FIG. 4 an installation diagram for the treatment zone according to FIG. 2,

FIG. 5 a schematic representation of the action of the treatment medium,

FIG. 6 an extended embodiment of a washing machine with counter flow,

FIG. 7 a modified embodiment with two treatment zones on an ascending material web, FIG. 8*a* a partial cross section through a modified embodiment of a washing machine with hollow shaft side walls.

Figure 8B:
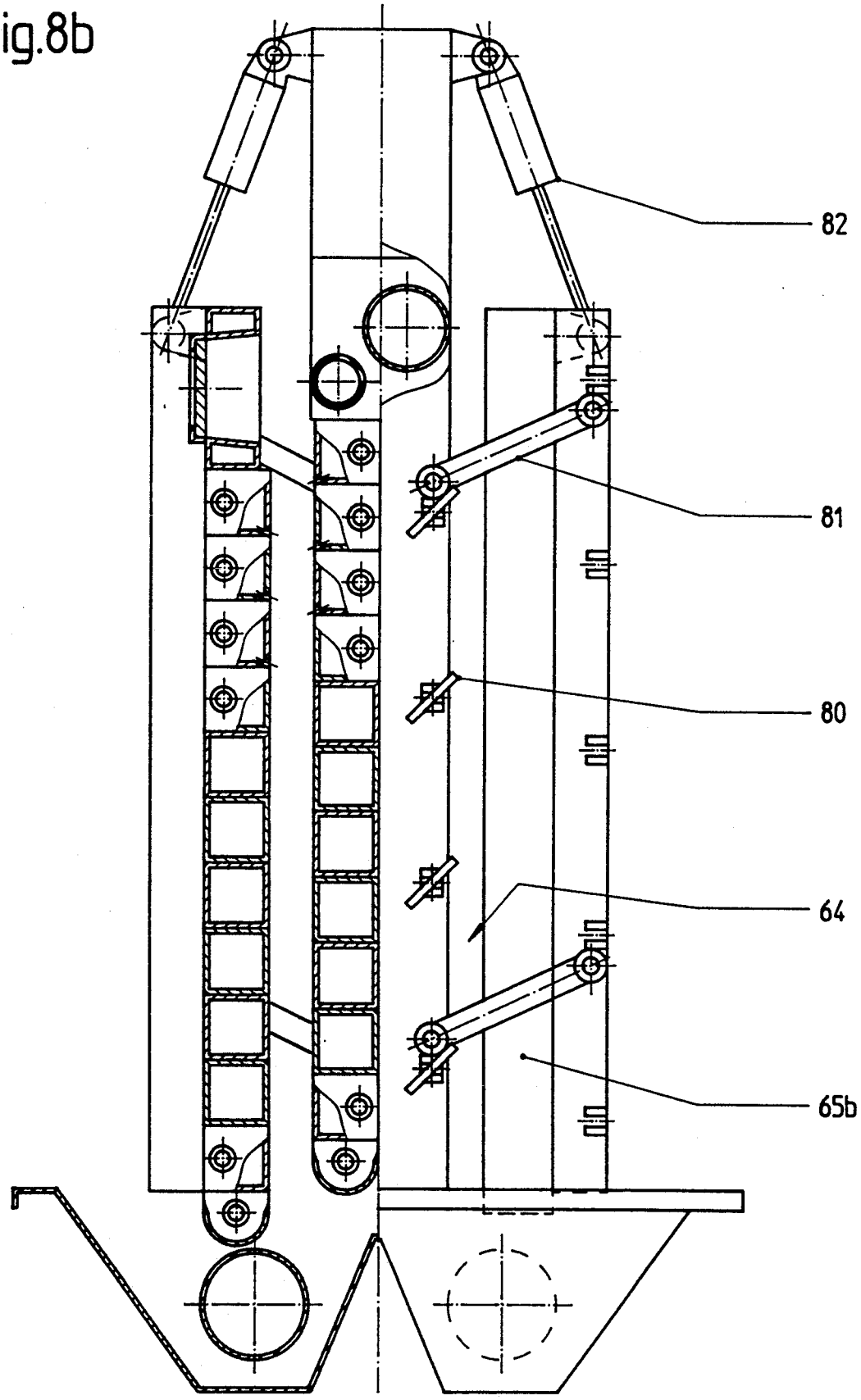

FIG. 8*b* the machine according to FIG. 8*a* with a closed up side-wall.

Figure 9:
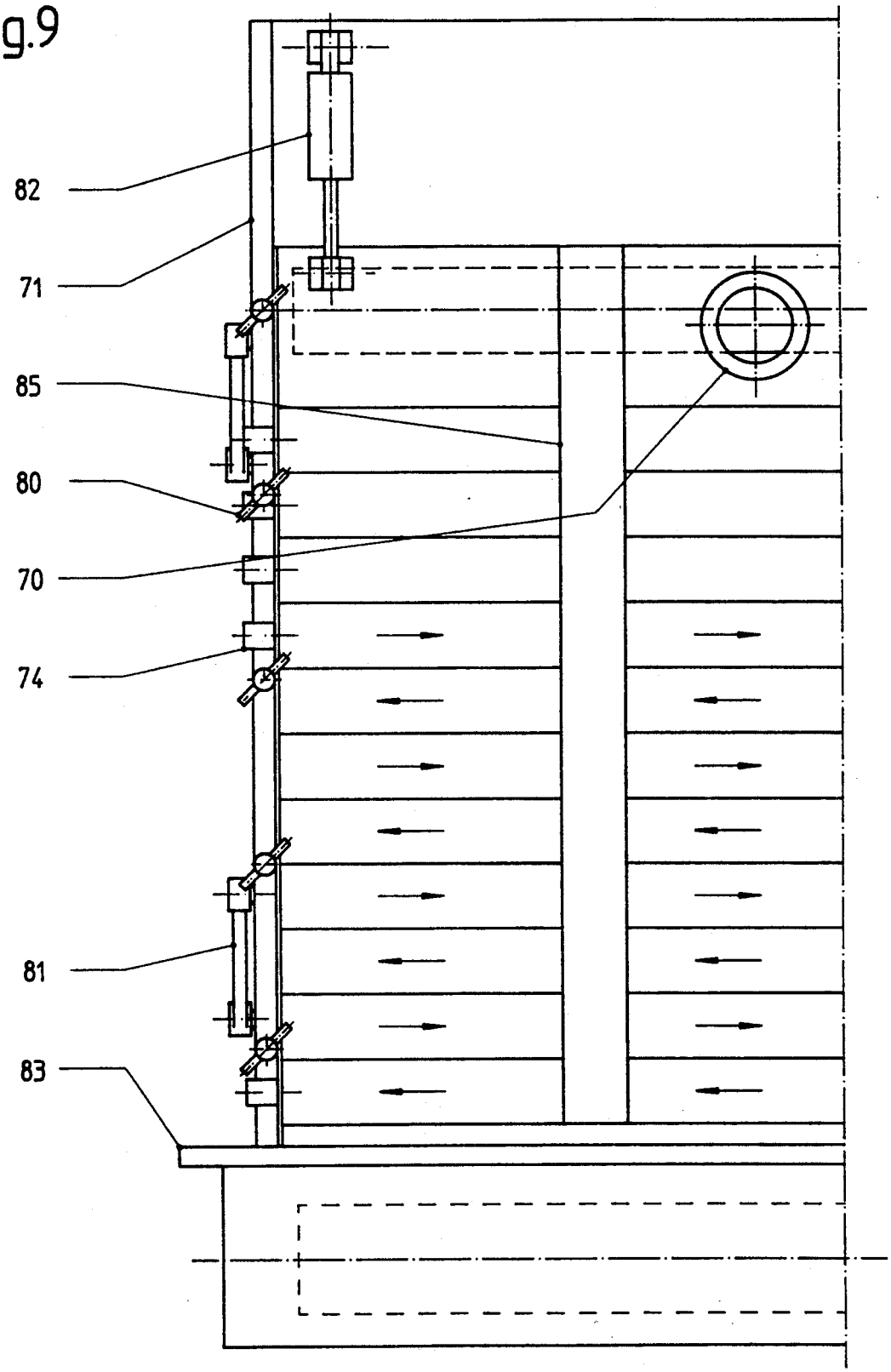

FIG. 9 a partial view of the machine according to FIG. 8*a* and

Figure 10:
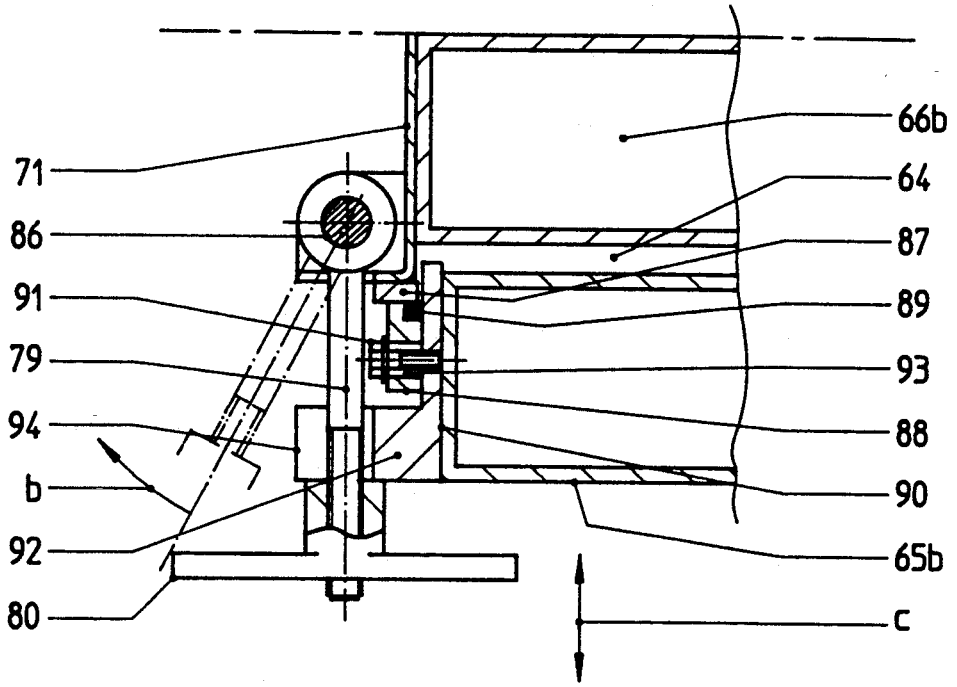

FIG. 10 a partial cross section through the facing end of a shaft as shown in FIG. 8*a*.

FIG. 1 shows a high performance washing compartment 1 which is constructed on the basis of a so-called roller vat and which exhibits an upper roller 2 and two lower rollers **3*a* and 3*b*. The latter are mounted in bearings in a trough 4 which can be formed with or without the partition 5 according to its intended use, or which can be fed with or without counterflow. The trough 4 possesses, for example, an outlet 6 for draining the chamber 7 and a pump connection 8 for feeding or drawing off the wash liquor. In the case where counterflow is provided, the wash liquor is fed in through a counterflow inlet 9 and drawn off once again through a counterflow outlet 10**.

The trough 4 is sealed against vapor escape to a considerable degree by covering plates 11, respectively by the lid 12, whereby the fabric web 15 is immersed into the trough 4 through an entry opening 13 and is withdrawn from the trough through an exit opening 14. When numerous high performance washing compartments 1 are combined, the fabric exit opening 14 is naturally in each case connected with its subsequent textile entry opening 13 in the form of a continuous shaft, so that losses are to a great extent avoided. (For example, see FIG. 6).

The two shafts 16 and 17 are arranged above the trough 4 so that the ascending and the descending span of the fabric web, guided over the upper roller 2, in each case runs through a separate shaft. Outer side covers are provided on the shafts 16 and 17 which facilitate the insertion of the fabric web 15 and which permit its observation. As portrayed, the upper roller 2 mounted in the upper part 19, deflects the material web 15 through approximately 180° degrees. According to the arrangement of both the lower rollers **3*a* and 3*b*, another deflection angle could be considered, whereby both the shafts 16 and 17 must be appropriately inclined. As is the case with the shafts 16 and 17**, also the upper part 19 is sealed with a closing lid 20 so that the material web is easily accessible from all sides. The upper part 19 forms a chamber which connects together, pressure sealed, both the shafts 16 and 17.

The collectors 21*a* to 21*d*, comprising individual collector tubes, which are integrated with the shaft, are arranged at the upper end of both the shafts 16 and 17. Individual details of this section can be observed in FIGS. 2 and 3. Each collector 21*a* to 21*d* comprises three, in cross section rectangular collector tubes 33, 34 and 35. The tubes could perhaps be also be formed exactly as squares. The tubes are welded together gastight, whereby a fixing bar 27, respectively 28 is welded, one onto the uppermost tube 33 and one onto the lowermost tube 35. The individual collectors are in this way directly formed as gastight wall sections of the shaft. The collectors form, apart from that, in each case a connecting wall between the shafts 16, respectively 17 and the upper part 19. In order to make lateral displacement of the collectors possible in the simplest way, intermediate pieces 22 and 23 are incorporated.

These intermediate pieces are formed as flanges and firmly bolted to the shafts 16 and 17, respectively to the upper part 19. Slotted holes 31, respectively 32 are arranged on the flange section which is oriented towards the collectors through which the fixing bolts 29, respectively 30 can be screwed into the fixing bars 27, respectively 28. Evidently, in this way the collectors allow themselves to be displaced according to the length of the holes 31, 32 at rightangles the plane of movement of the material web running in the direction of the arrow 16 so that the distance 25 between two neighbouring collectors 21*a* and 21*b* can be adjusted. In certain cases it would be naturally also conceivable to mount the collectors in a fixed position.

A side wall 56*a*, respectively 56*b*, is provided for the lateral sealing between both the collectors, one for each, which is pressed against the collectors to create the seal. These side walls could also at the same time perhaps directly seal the individual collectors at the sides. In the place of a fixed side wall the collectors could also be sealed at their sides with a bellows or with another flexible wall, for example made of rubber or similar. Each collector tube 33 to 35 is equipped with a separate connection piece 36, 37 and 38, whereby each connection piece is arranged approximately in the centre of the collector tube. In this way uniform distribution is ensured over the entire width. In certain cases, however, numerous connection pieces can be distributed along the entire length of a collector tube.

In order to avoid distortion of the tubes under the influence of pressure of the treatment medium, support rods 42 can be welded into the tubes at definite intervals.

The nozzles directed against the fabric web 15 can be formed in entirely different ways. Thus, for example, the tubes 33 and 34 are provided with numerous outlet openings 39 and 40, through which the treatment medium supplied to them can strike the fabric web 15 inclined at an angle 41. Within the collector tube 35, larger outlet openings 43, which are directed at a rightangle against the fabric web, are arranged instead of the smaller outlet openings 35. These could, however, be inclined in relation to the fabric web. In place of the individual openings, a slit nozzle could extend over the entire length of a collector tube.

In the portrayed embodiment according to FIG. 2, the nozzles of the collector tubes 33, 34 and 35 are arranged on a plane running parallel to the fabric web 15. It would naturally also be conceivable that each individual collector tube of a collector is able to be separately adjusted so that the nozzle is able to be arranged at differing distances from the fabric web. It would, however, also be conceivable to connect the individual collector tubes with one another, displaced in relation to one another, in such a way that the nozzles of the individual tubes exhibit differing distances from the fabric web. Finally, it would even be conceivable to alter the nozzle cross section from the outside with a slider or similar or, in the same way, to completely close off individual nozzles.

Vapor 44 is fed through the connection pieces 36 at a definite pressure and at a definite temperature, for example saturated steam, and is blown onto the fabric web 15 through the outlet openings 39 at an angle 41. Similarly, air 45 is fed through the connection pieces 37 at a definite temperature and at a definite pressure and blown onto the fabric web 15 through the outlet openings 40 at an angle 41. Finally, washing water 46 of a definite quality and at a definite temperature and at a definite pressure is fed through the connection pieces 38 and sprayed onto the fabric web 15 at a rightangle through the outlet openings 43. The washing water 46 can, at the same time, be mixed with additional chemicals which support the washing process.

The diameters of the outlet openings 39 and 40 lie in the region of approximately 1 mm and the diameters of the outlet openings 43 lie in the region of approximately 4 mm. The distance between the shaft walls of the shafts 16 and 17 is, as a rule, approximately the same as the distance 25 between the collectors 21*a* and 21*b*, respectively 21*c* and 21*d*, thus approximately 4 mm, whereby as already mentioned above, differing distances between the individual collector tubes are possible. The distance could, however, also be greater and amount to up to 40 mm. In order that the fabric web 15 is not damaged by the collector tubes 33 to 35, which are very near, these are provided with rounded corners of a relatively large radius. These permit, in addition, recessed joining welds, whereby the resulting weld bead does not protrude.

The supplied vapor can exhibit a temperature of, for example, 105 to 110 degrees Celsius. With that, a pressure of approximately 0.8 bar can build up in the shaft, respectively in the upper part 19. The vaporous medium flows turbulently downwards in the shaft at relatively high speed, whereby it partly mixes with the washing water and vaporizes it. The downward flowing treatment mediums exhibit a high degree of charging, whereby the liquor collected in the trough 4 has a high concentration. Vapor and/or air are drawn off at the lower end of the shaft and can be re-used within an internal circuit. The blowing in of air can, for example, serve the purpose of triggering certain chemical reactions, such as, for example, oxidation of individual materials. Compressed air at high temperature, which is relatively easy to produce, could, however, also solely serve as a reduction in the consumption of vapor.

In FIG. 4, the piping leading to the collectors 21*a* to 21*d* is schematically portrayed. A separate flow meter 47 is provided, one for each medium, Vapor D44, air L45, and water 46 W1 and W2 in two different qualities, and the flow meters are each followed by a hand valve 48 for manual flow control.

After the handvalves 48, the piping separates to form the supply to the individual collector tubes 33 to 35, whereby each collector tube can be likewise equipped with a hand valve 49. For reasons of clarity, the piping to the inner collectors 21*b* and 21*c* is not shown.

It is now possible with this arrangement to control the dosage of the individual treatment medium volumes or, as the case may be, to interrupt them completely. With the aid of corresponding pressure regulating valves, the respective pressure could also be set, particularly in the case of gaseous treatment mediums. For efficient operation with optimum treatment effect, the feed of the individual treatment mediums can be preferably automatically controlled, whereby the desired value can be set on a nominal value transmitter. The mixing of certain additives for support of the washing process could also be included in this regulation system.

The arrangement portrayed in this embodiment is based on the intention to heavily reduce the consumption of water through the use of air and/or vapor, and additionally to improve and accelerate the cleansing effect on the fabric. The intensive flow against the fabric web 15 leads to rapid removal of impurities, whereby the effect of the nozzles situated on the collector tubes is further supported by the high speed of fabric web. As a result of the relatively low water volume supplied, the components which are washed out, such as, for example, starch size or dyes, arise in high concentrations, which facilitates the purification of the waste water. A discolouration of the fabric web through soiled water must also not be feared.

In the portrayal 5, the flow conditions at a washing stage are once again shown in principle. The same or similar conditions could, however, be provided for other treatment processes such as, for example, sizing, impregnating or print aftertreating. The span 50 of the fabric web 15 leading upwards to the upper roller 2 is initially sprayed with a small volume of water 46. The water jet is subsequently immediately superimposed by an intensive jet of air 45, respectively vapor 44, so that mixing with the water 46 takes place. The conditions in the case of the span 51 running downwards are similar, whereby the application of the individual treatment mediums takes place in the reverse sequence. The addition of air 45 fed to the vapor 44 has the advantage that the very energy demanding vapor 44 can be reduced to a minimum. In certain cases it is even conceivable that, apart from the liquid treatment medium, air can be exclusively employed which is heated to a definite temperature, according to the particular case. Naturally the sequence on the downward running span 51 could also be altered in such a way that on the other hand, in the feed direction, firstly water 46, then air 45 and then vapor 44 can be applied.

An alternative embodiment of the invention with numerous washing compartments is shown in FIG. 6. The individual washing compartments can be formed in approximately the same way as is shown in FIG. 1. The connection ensues with the aid of an intermediate chamber 54 which connects two washing compartments together, vapor-tight. In the intermediate chamber 54, an upper roller is likewise arranged. The feed of air and vapor ensues immediately into the individual treatment zones, approximately according to the diagram in FIG. 4. As opposed to that, the feed of water ensues preferably in counterflow. With that, liquid is withdrawn from, for example, the last chamber 7*d* of the second compartment with the aid of the pump 52 and is fed through the counterflow piping 53 into the collector 21*a* of the second compartment 1*b*. From there the washing liquid flows through the shaft into the chamber 7*c* assigned to the collector 21*a* in the second compartment 1*b*, and is withdrawn again with the aid of a pump through the pump connection 8 and fed to the collector 21*d* of the first compartment 1*a*. The liquid is withdrawn from the chamber 7*d* of the first compartment 1*a* once again and fed to the collector 21*a* of the first compartment until the liquid is entirely withdrawn from the first chamber 7*a* through the drain 6. Without the series connected pump, the liquor level could be evened out through the connections 9 and 10 between the chambers 7*b* and 7*c*.

It can also be seen from the embodiment according to FIG. 6 that fresh water is fed to the collector 21*d* of the second compartment 1*b* through the fresh water feed 55. Simultaneously, however, fresh water is also led onto the upper roller of the second compartment 1*b*, so that the liquor in the chamber 7*d* only exhibits a slight degree of impurity.

Finally, in FIG. 7 a further fabric web guidance is depicted where the collectors 21 are arranged only on the ascending span. With that, a first shaft 58 leads to a first deflection roller 60. From there the fabric web leads to a lower lying second deflection roller 61 and is simultaneously immersed in an intermediate bath 62. Subsequently the fabric web ascends again through the second shaft 59 on which the collectors are once again arranged. The intermediate bath 62 is equipped with a drain which, for example, can be formed as the suction pipe of a pump.

The embodiments according to FIGS. 8*a* and 9 show a device which, as far as the method is concerned, functions in the same way as the device according to FIG. 1, but which, however, has another type of construction. The ascending shaft 63 and the descending shaft 64 are formed by practically uninterrupted hollow side walls. In the FIGS. 8*a* and 8*b*, in each case the left half of the picture shows a cross section through the ascending shaft 63, whilst the right half of the picture shows a side view. The inner side walls 66*a* and 66*b* are connected firmly together and are held on both their faces by pillars 71. As opposed to that, the outer side walls 65*a* and 65*b* are able to be displaced, respectively hinged outward in the way described more exactly in the following. In this way the gap width of each shaft can be optimally adjusted, and the shafts are easily accessible for preparation or cleaning work.

The side walls are formed essentially by hollow box profiles 68 which are stacked one on top of the other, and which are closed off at their faces. With that, the three uppermost hollow box profiles 76, 77 and 78 form a collector tube with the outlet nozzles 95 directed against the shaft. The connection possibilities and the effect of these collector tubes have already been described above. Additionally, however, the possibility of heating the entire hollow wall also exists with this embodiment. For this purpose a connection piece 74 is provided on each side wall through which steam, for example, can be fed. The hollow box profiles are connected together by openings in such a way that the heating vapor flows downwards in the shape of a meander, as suggested by the arrows in FIG. 9. The vapor, respectively the product of condensation is drawn off at the outlet connection piece 75. A uniform temperature is achieved by this means within the hollow side walls, so that no undesired distortion can occur. The vapor exiting on the lower end of the shaft is removed through a vapor exhaust 84, while the liquid components run into the bath 83.

Both the outer side walls 65*a* and 65*b* are suspended, each by a pressure cylinder 82 on the pillars 71, respectively on one of the transverse beams which connect the two pillars, on both sides. At the same time, the outer side walls are connected to the pillars by an articulated lever 81 as well, however at their sides. In this way the side walls can be hinged open like a parallelogram in the direction of the arrow a as is represented in FIG. 8*b*. The pressure cylinders merely serve the purpose of holding the side walls, respectively of determining the degree of opening.

The connection between the inner and the outer side walls, respectively the contact pressure, is achieved by means of a special tensioning device. Details in this respect can be seen in FIG. 10. Tensioning rods 79, which can be pivoted laterally outwards around the linkage pins 86 in the direction of the arrow b, are fastened on the pillars 71 at definite intervals. The tensioning rods are provided with a thread on to which a tensioning lever or a hand wheel is screwed. Whilst the inner side walls 66*a* and 66*b* are arranged firmly between the pillars 71, the outer side walls 65*a* and 65*b* exhibit on their sides companion pieces 92 into which the tensioning rods 79 can be introduced through a lateral slot 94. The tensioning levers 80 engage in the companion pieces so that the outer side walls allow themselves to be pressed against the inner side walls.

The lateral sealing of the shaft 64 ensues on the sealing surface 87, which can be precision machined. This sealing surface is, for example, formed by a strip which is welded to the side of the pillar 71. With that, the pillar in practice forms a face wall for the shaft 64. An elastic seal 89 is pressed with the aid of a sealing strip 88 onto the sealing surface 87. The sealing strip is provided at regular intervals with a slotted hole 93, through which a tensioning bolt 91 engages into the side part 90. Evidently the sealing strip 88 can, in this way, be adjusted in the direction of the arrow c in relation to the side part 90, and with that in relation to the outer side wall 65*b*, by which means also the gap width of the shaft 64 can also be adjusted.

In order to hinge the outer side wall 65*b* upwards, respectively for readjustment of the gap width, all available tensioning levers 80 are released so that the tensioning rods 79 can be laterally pivoted out, as suggested by the dotted line in FIG. 10. Subsequently the pressure cylinder 82 is activated. In order to close the shaft, the reverse sequence is carried out. Naturally, the adjustability of the outer side walls could be solved through other mechanical means.

Both the shafts 63 and 64 communicate with one another at the upper end through a chamber 67. This chamber is limited upwards by a cover 69. A deflection roller 72 is arranged in the chamber, whereby spreading rollers 73 can be further provided. The deflection zone can be observed from both sides through port holes 70.

The strengthening profile 85 extends over the entire height of the outer side walls. In addition, the outer side walls can further be provided with an insulating layer on the outside in order to keep heat loss as low as possible.

The feed piping, respectively the drain piping for the liquor in the bath 83, are here not depicted in any greater detail. We refer to the execution and layout of the preceding embodiments.

We claim:

1. A method of treating a material web, comprising steps of guiding said material web under tension through at least one approximately vertical shaft having side walls which enclose the material web relatively closely, said shaft having therein plural successive rows of nozzles disposed immediately one after another at its upper end, directing both a liquid treatment medium and a separate gaseous treatment medium, through separate respective successive rows of nozzles, at the material web over its entire width, as it passes through the shaft, in such a way that turbulent flow arises, while maintaining pressure within the shaft at above atmospheric pressure, and drawing off the treatment mediums at the shaft's lower end.

2. A method according to claim 1, wherein the gaseous treatment medium comprises saturated stream and the liquid treatment medium comprises a wash liquor.

3. A method according to claims 1 or 2, wherein the treatment mediums are directed at both sides of the material web.

4. A method according to claims 1 or 2, wherein the material is guided through at least two separate shafts, an ascending span of the material web being guided through one of said shafts, and a descending span of the material web being guided through another of said shafts, and wherein, in each shaft, the treatment mediums are applied at the upper end of the shaft, and both the shafts intercommunicate at their upper ends.

5. A device for treating a material web comprising means defining a treatment zone, said means comprising at least one approximately vertical shaft having side walls which enclose the material web relatively closely, two arrangements of nozzles integrated into the respective side walls, which nozzles extend over the entire width of the web, each arrangement of nozzles being formed by a collector tube having separate feed pipes through which respective liquid and gaseous treatment mediums may be fed, wherein two shafts, one for an ascending span of the material web, and one for a descending span of the material web, are connected together at their upper end by a pressure tight chamber and further comprising means for deflexion of the material web, arranged within the chamber.

6. A device for treating a material web comprising means defining a treatment zone, said means comprising at least one approximately vertical shaft having side walls which enclose the material web relatively closely, two arrangements of nozzles integrated into the respective side walls, which nozzles extend over the entire width of the web, each arrangement of nozzles being formed by a collector tube having separate feed pipes through which respective liquid and gaseous treatment mediums may be fed, wherein the treatment zone is formed by two parallel, approximately vertical shafts which enclose the material web relatively closely and which are connected at their upper end by a pressure tight chamber in which means for deflexion of the material web is arranged, and further comprising at least two arrangements of nozzles on both sides of the material web at the end of each shaft, which are oriented towards the chamber.

7. A device according to claim 5 or claim 6, wherein the collector tubes directly form a wall part of the shaft.

8. A device according to claim 5 or claim 6, wherein at least three of the collector tubes are joined together as a unit.

9. A device according to claim 5 or claim 6, wherein arrangements of nozzles are positioned opposite one another on both sides of the shaft.

* * * * *